US008149179B2

(12) United States Patent
Crouch

(10) Patent No.: US 8,149,179 B2
(45) Date of Patent: Apr. 3, 2012

(54) LOW LOSS VARIABLE PHASE REFLECT ARRAY USING DUAL RESONANCE PHASE-SHIFTING ELEMENT

(75) Inventor: David D. Crouch, Corona, CA (US)

(73) Assignee: Raytheon Company, Waltham, MA (US)

( * ) Notice: Subject to any disclaimer, the term of this patent is extended or adjusted under 35 U.S.C. 154(b) by 327 days.

(21) Appl. No.: 12/475,383

(22) Filed: May 29, 2009

(65) Prior Publication Data

US 2010/0302120 A1 Dec. 2, 2010

(51) Int. Cl.
*H01Q 15/14* (2006.01)

(52) U.S. Cl. ..... 343/837

(58) Field of Classification Search ..... 343/837, 343/702, 754–755, 909
See application file for complete search history.

(56) References Cited

U.S. PATENT DOCUMENTS

| | | | | |
|---|---|---|---|---|
| 4,905,014 | A | 2/1990 | Gonzalez | |
| 5,153,061 | A * | 10/1992 | Cavagna et al. | 428/325 |
| 5,864,322 | A | 1/1999 | Pollon | |
| 6,020,853 | A | 2/2000 | Richards | |
| 6,091,365 | A | 7/2000 | Derneryd | |
| 6,396,449 | B1 | 5/2002 | Osterhues | |
| 6,744,411 | B1 | 6/2004 | Osterhues | |
| 6,795,020 | B2 | 9/2004 | Sreenivas | |
| 6,885,355 | B2 | 4/2005 | Killen | |
| 6,900,763 | B2 | 5/2005 | Killen | |
| 7,142,164 | B2 * | 11/2006 | Legay et al. | 343/754 |
| 2003/0122729 | A1 * | 7/2003 | Diaz et al. | 343/909 |
| 2004/0100343 | A1 | 5/2004 | Tsu | |
| 2005/0122266 | A1 | 6/2005 | Chang | |
| 2009/0079645 | A1 * | 3/2009 | Sotelo et al. | 343/755 |

FOREIGN PATENT DOCUMENTS

EP 1 120 856 8/2001

OTHER PUBLICATIONS

Eng-Chi E. Tai, Marek E Bialkowski, Designing a 161-Element Ku-Band Microstrip Reflectarray of Variable Size Patches Using an Equivalent Unit Cell Waveguide Approach, IEEE Transactions on Antennas and Propagation, vol. 51, No. 10, Oct. 2003, p. 2953.

World Intellectual Property Organization, International Search Report and Written Opinion for International Application No. PCT/US2010/036425, mail date Jul. 30, 2010, pp. 1-7.

Malibu Research, "Introduction to FLAPS." Flat Parabolic Surface (FLAPS) Antenna Technology, available at: http:maliburesearch.com/technology.htm. 8pp., printed May 8, 2007.

* cited by examiner

*Primary Examiner* — Huedung Mancuso
(74) *Attorney, Agent, or Firm* — Daly, Crowley, Mofford&Durkee, LLP

(57) ABSTRACT

There is disclosed a reflect array including a dielectric substrate having a first surface and a second surface. The first surface may support an array of phase-shifting elements. The second surface may support a conductive layer. At least some of the phase-shifting elements may be dual resonance phase-shifting elements.

15 Claims, 8 Drawing Sheets

LOW LOSS VARIABLE PHASE REFLECT ARRAY USING DUAL RESONANCE PHASE-SHIFTING ELEMENT

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to reflectors for microwave and millimeter wave radiation.

2. Description of the Related Art

A passive reflect array is an array of conductive elements adapted to reflect microwave or millimeter wave radiation within a predefined wavelength band. The array of conductive elements is typically separated from a continuous ground plane by a thin dielectric layer such that the incident microwave or millimeter wave radiation is reflected by the combined effect of the ground plane and the conductive elements. Since the incident radiation may be reflected with a phase shift that is dependent on the size, shape, or other characteristic of the conductive elements, the term "phase-shifting element" will be used to describe the conductive elements of a reflect array.

The size, shape, or other characteristic of the phase-shifting elements may be varied to cause a varying phase shift across the extent of the array. The varying phase shift may be used to shape or steer the reflected radiation. Reflect arrays are typically used to provide a reflector of a defined physical curvature that emulates a reflector having a different curvature. For example, a planar reflect array may be used to collimate a diverging microwave or millimeter wave beam, thus emulating a parabolic reflector.

Reflect arrays which include crossed-dipole phase-shifting elements are described in U.S. Pat. No. 4,905,014. FIG. 8 shows a graph 800 of data, obtained by simulation, showing the performance of a cross-dipole reflect array as a function of the dipole length dimension $L_{dipole}$ for normally-incident radiation. The data summarized in the graph 800 was simulated for a frequency of 95 GHz using specific assumptions for the substrate material, substrate thickness, grid spacing $D_{grid}$, and dipole width $W_{dipole}$. In FIG. 8 (and FIGS. 3, 5, and 6 to be subsequently described), the plotted phase shift is defined as the phase difference between a simulated incident wavefront and a reflected wavefront, both measured at a reference plane displaced from the surface of the reflect array. Thus the phase shift data contains a constant phase offset due to the round trip propagation from the reference plane to the reflect array and back.

As shown by the curve 810, the phase shift may be varied from about +105 degrees to +156 degrees (after wrapping through ±180 degrees) by varying the dipole length from less than 10 mils (0.010 inches) to more than 70 mils (0.070 inches). However, for the assumed combination of substrate material, substrate thickness, grid spacing $D_{grid}$, and dipole width $W_{dipole}$, it is not be possible to achieve a phase shift between +156 degrees and +105 degrees, leaving a "gap" of about 51 degrees. The inability to achieve a continuously variable phase shift over a 360-degree range may limit the capability of a reflect array to accurately direct and form a reflected beam.

As shown by the dashed curve 820, the simulated reflection loss also varies with the dipole length. The reflection loss curve shows a single peak, at a dipole length about 0.042 inch, due to a resonance within the phase-shifting elements. For a crossed-dipole reflect array, the reflection loss peak may occur when the dipole length is equal to one-half of the wavelength of the reflected radiation (including the effect of the dielectric constant of the substrate). The reflection loss peak may occur when the length of the dipole is such that the dipole resonates at the wavelength being reflected from the reflect array. As shown by the solid curve 810, the dependence of phase shift on the dipole length is strongest in the vicinity of the resonance. The phase shift varies substantially when the dipole length is varied from about 0.03 inch to about 0.05 inch, but is relatively constant for dipole lengths less than about 0.03 inch or greater than about 0.05 inch.

DETAILED DESCRIPTION

Within this description, the term "shape" is used specifically to describe the form of two-dimensional elements, and the term "curvature" is used to describe the form of three-dimensional surfaces. Note that the term "curvature" may be appropriately applied to flat or planar surfaces, since a planar surface is mathematically equivalent to a curved surface with an infinite radius of curvature. When applied to a shape or a line, the term "solid" means unbroken, but does not imply significant depth. The term "microwave" is used to describe the portions of the radio frequency spectrum above approximately 1 GHz, and thus encompasses the portions of the spectrum commonly called microwave, millimeter wave, and terahertz radiation. The term "phase shift" is used to describe the change in phase that occurs when a microwave beam is reflected from a surface or device. A phase shift is the difference in phase between the reflected and incident beams. Within this description, phase shift will be measured in degrees and defined, by convention, to have a range from −180 degrees to +180 degrees.

Description of Apparatus

Figure 1:
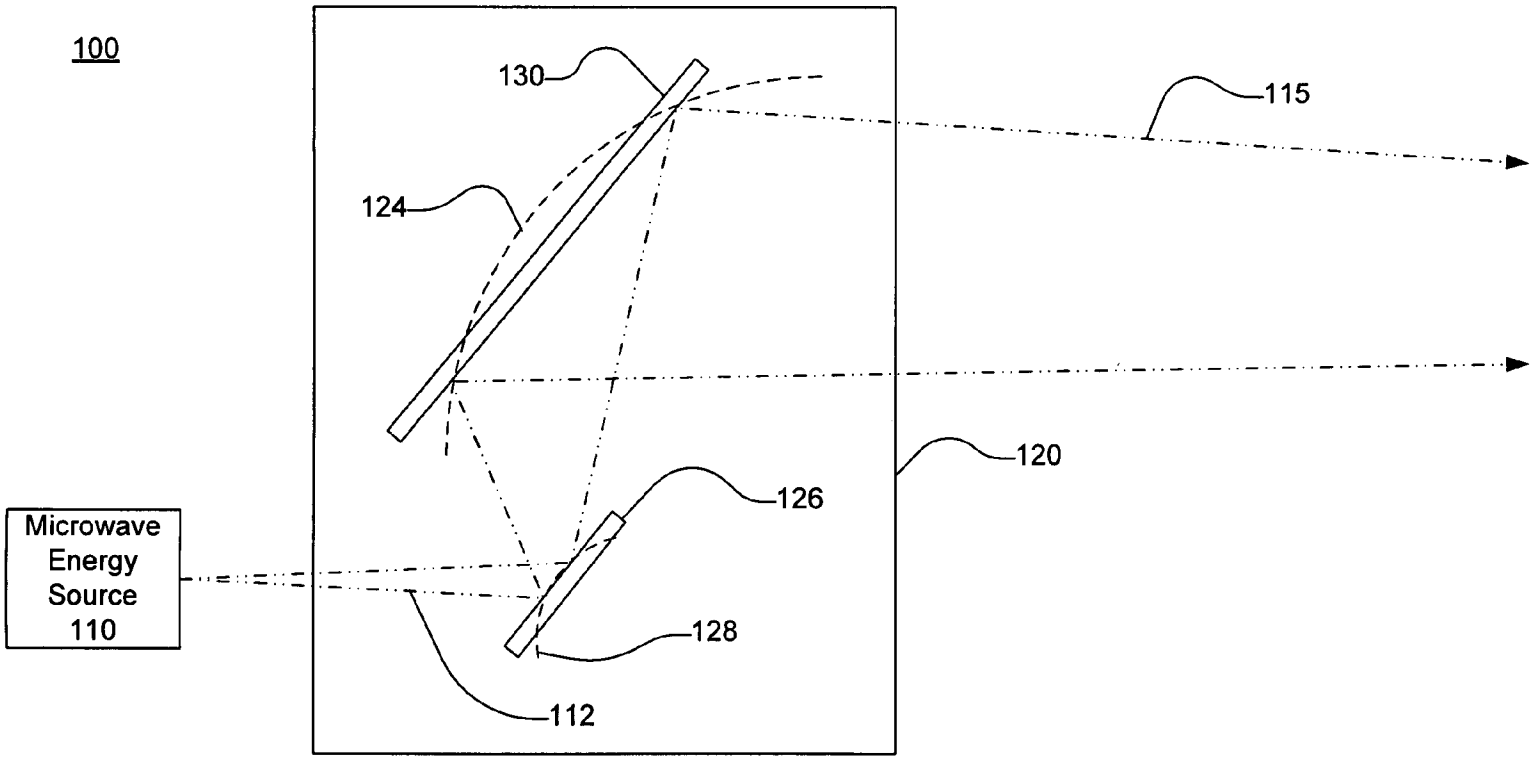
FIG. 1 is a block diagram of a system to generate a beam of microwave energy.

Referring now to FIG. 1, an exemplary system for generating a beam of microwave energy may include a source of microwave energy 110 and a beam director 120. The source of microwave energy 110 may be a solid state source, a vacuum tube source, or another source providing microwave energy. The beam director 120 may include one or more beam forming elements such as a primary reflector 130 and a secondary reflector 126. The beam director 120 may receive microwave energy 112 from the microwave energy source 110 and may form the received microwave energy 112 into a beam of microwave energy 115. The beam of microwave energy 115, shown as a converging beam in FIG. 1, may be a collimated beam, a diverging beam, or a beam having some other wavefront figure.

In order to transform the incident microwave energy 112 into the desired beam of microwave energy 115, the primary reflector 130 may need to function as an aspheric reflector, as indicated by the dashed shape 124. For example, the primary reflector 130 may need to function as an off-axis parabolic reflector. However, to provide a well-controlled wavefront, the shape of the primary reflector may need to be accurate within a small fraction of a wavelength at a microwave frequency of operation. For example, at a wavelength of 95 GHz, the surface figure of the primary reflector 130 may need to be accurate within a few thousandths of an inch. This accuracy may be required over a curved shape that may have a diameter of, for example, 3 feet or larger. Maintaining tight tolerances over a large aspheric shape may greatly increase the cost of an aspheric primary reflector.

Since maintaining the required mechanical tolerances may be comparatively easy over a planar surface, the primary reflector 130 may be a reflect array comprised of an array of conductive phase-shifting elements on a planar substrate. By varying the geometry of the phase-shifting elements across the array, the phase of reflected microwave energy may be varied such that the wavefront reflected from a planar primary reflector 130 is the same as the wavefront reflected from the hypothetical curved reflector 124. In this manner, the planar reflect array 130 may be said to emulate the curved reflector 124.

In the exemplary beam director 120, the secondary reflector may be a second planar reflect array 126 or a curved reflector as indicated by the curved surface 128.

Figure 2A:
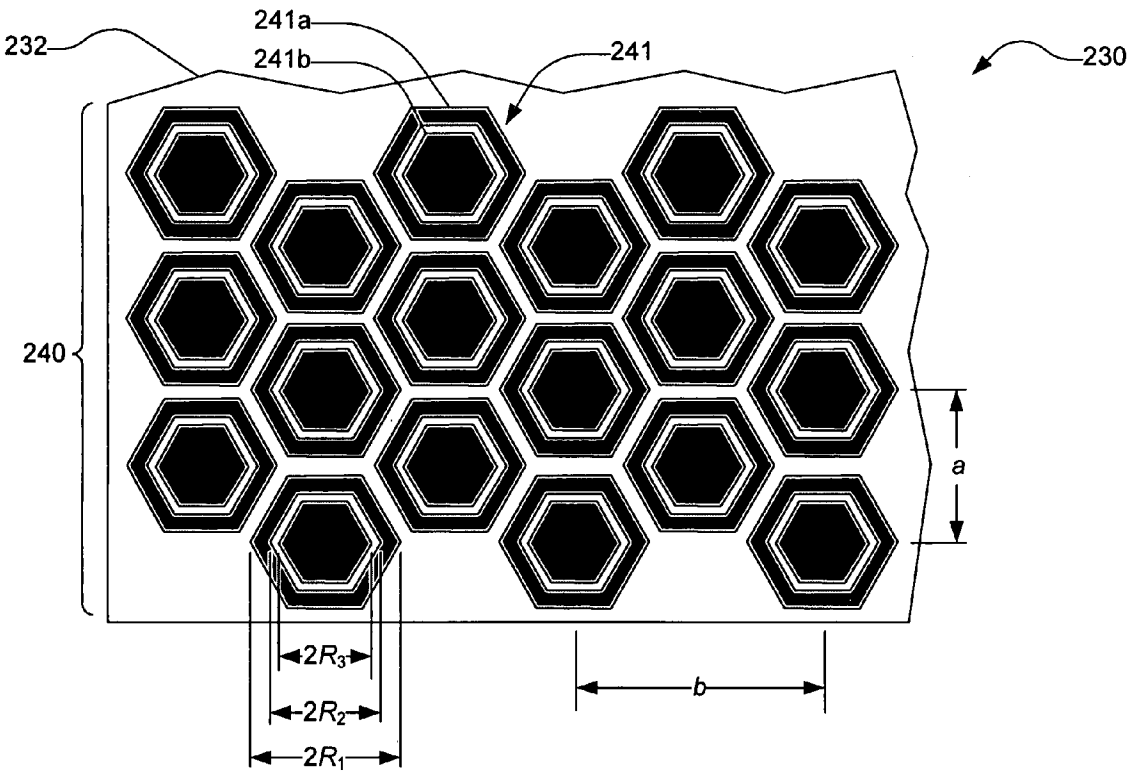
FIG. 2A is a plan view of a variable phase reflect array.

Referring now to FIG. 2A, an exemplary reflect array 230, which may be suitable for use as the primary reflector 130, may include a two-dimensional array 240 or grid of phase-shifting elements. Although the phase-shifting elements shown in FIG. 2A are uniform, the dimensions and shape of each phase-shifting element may determine the electrical phase shift induced when microwave radiation is reflected from the reflect array. The phase-shifting elements may be disposed on a triangular grid, which is to say that the phase-shifting elements in a given row may be laterally offset from the phase-shifting elements in an adjacent row. The distance between adjacent rows may be a dimension a. The distance between adjacent phase-shifting elements in each row may be a dimension b which is related to the dimension a by the formula $$b=2a\cos(30°)\approx 1.732a.$$

In this description, the terms "rows" and "columns" refer to the elements of the reflect array as shown in the figures and do not imply any absolute orientation of the reflect array. The reflect array 230 may be adapted to reflect microwave radiation within a predetermined wavelength band. The dimension a may be less than one wavelength, and may be about 0.5 wavelengths, of the microwave radiation in the predetermined frequency band.

As illustrated in the exemplary reflect array 230, each phase-shifting element, such as the phase-shifting element 241, may have a nested hexagon shape including an outer annular hexagonal ring 241*a* surrounding and concentric with a central hexagonal shape 241*b*. The outer annular hexagonal ring 241*a* may be characterized by the dimensions $R_1$ and $R_2$, which are the radii of circles that may be drawn through the vertices of the outer and inner hexagons, respectively. The central hexagonal shape 241*b* may be characterized by a dimension $R_3$, which is the radius of a circle that may be circumscribed about the shape 241*b*. The phase-shifting elements may have other shapes such as nested circles, nested squares, and other polygonal shapes.

Figure 2B:
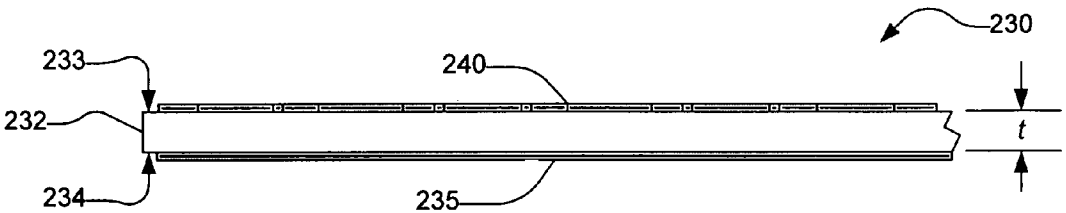
FIG. 2B is a side view of a variable phase reflect array.

Referring now to FIG. 2B, the exemplary reflect array 230 may include a dielectric substrate 232 having a first surface 233 and a second surface 234. The dielectric substrate may be a ceramic material, a composite material such as DUROID® (available from Rogers Corporation), or some other dielectric material suitable for use at the frequency of interest. The dielectric substrate 232 may have a thickness t. The thickness t may be greater or equal to about 1/16 of the free-space wavelength of the predetermined frequency band. The thickness t may be less than or equal to 1/4 of the free-space wavelength of the predetermined frequency band. The thickness may be about 0.0805 times the free-space wavelength of the predetermined frequency band. For example, the thickness t may be 0.010 inches for operation at a frequency of 95 GHz. The thickness t may vary or may be constant over the extent of the reflect array 230.

The second surface 234 may support a conductive layer 235. The conductive layer 235 may be continuous over all or almost all the second surface 234 and may function as a ground plane. The conductive layer 235 may be a thin metallic film deposited onto the second surface 234, or may be a metallic foil laminated to the second surface 234. The conductive layer 235 may be a metal element, such as a metal plate that may also function as a structural support and/or heat sink, bonded or otherwise affixed to the second surface 234.

The first surface 233 may support the array 240 of conductive phase-shifting elements. The phase-shifting elements may be formed by patterning a thin metallic film deposited onto the first surface 233, or by patterning a thin metallic foil laminated onto the first surface 233, or by some other method.

Although the phase-shifting elements shown in FIG. 2A and FIG. 2B are uniform, at least one of the characteristic dimensions $R_1$, $R_2$, and $R_3$ of the phase-shifting elements may be varied across the reflect array 230. The variation in the dimension of the phase-shifting elements may result in a variation of the phase shift of microwave radiation reflected from specific portions of the reflect array 230. By properly varying the phase shift across the extent of a reflect array, a reflect array having a first curvature may be adapted to emulate the optical characteristics of a reflector having a second curvature different from the first curvature. A planar reflect array may be adapted to emulate a parabolic reflector, a spherical reflector, a cylindrical reflector, a torroidal reflector, a conic reflector, a generalized aspheric reflector, or some other curved reflector. A reflect array having a simple curvature, such as a cylindrical or spherical curvature, may be adapted to emulate a reflector having a complex curvature such as a parabolic reflector, a torroidal reflector, a conic reflector, or a generalized aspheric reflector.

Figure 3:
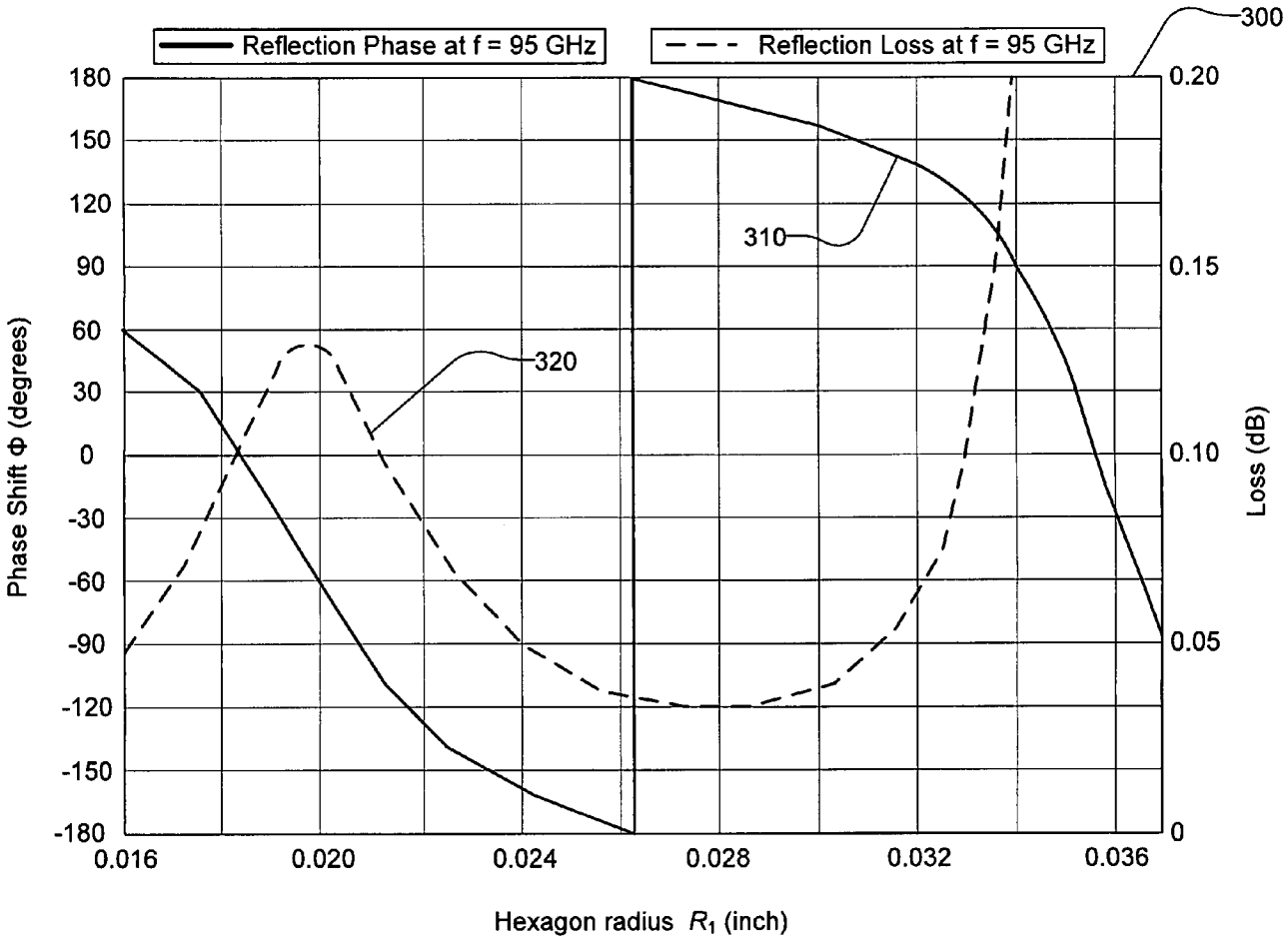
FIG. 3 is a graphical representation of simulation results showing the performance of a variable phase reflect array.

Referring now to FIG. 3, a graph 300 summarizes simulated performance data for a reflect array which incorporates nested hexagonal phase-shifting elements similar to those shown in FIG. 2. The graph 300 shows the dependence of reflection phase shift and reflection loss on the dimension $R_1$, which was defined in FIG. 2. The phase shift, in degrees, is shown by a solid line 310. The reflection loss, in dB, is shown by a dashed line 320.

The performance data shown in the graph 300 was derived from simulation using the following assumptions: normal incidence; frequency=95 GHz; substrate thickness t=0.010 inch; substrate material=DUROID®; dimension a=0.065 inch; dimension b=0.112 inch; dimension $R_2=R_1-0.011$ inch; and dimension $R_3=R_2-0.004$ inch.

As shown by the solid line 310, a variable phase reflect array implemented with nested hexagonal-phase-shifting elements can produce any desired phase shift value from −180 degrees to +180 degrees. However, as shown by the dashed line 320, the simulated reflection loss increased rapidly for values of the hexagon radius $R_1$ greater than about 0.032 inch. The reflection loss is greater than 0.2 dB when the hexagon radius $R_1$ is greater than 0.034 inch. As shown by the solid line 310, phase shift values between +90 degrees and +60 degrees are only achieved, in this example, when the hexagon radius $R_1$ is greater than 0.034 inch, which is to say that phase shift values between +90 degrees and +60 degrees are accompanied by relatively high reflection loss.

As shown by the dashed line 320, the simulated reflection loss has a local peak at $R_1 \approx 0.0196''$ and a second resonance peak (not visible in FIG. 3) at $R_1 \approx 0.356''$, indicating that resonance occurs at two different values of the hexagon radius $R_1$. Phase-shifting elements that exhibit two resonances, or two loss peaks, as the size of the phase-shifting elements are varied over an allowable range will be referred to as "dual resonance" phase-shifting elements. The nested hexagon shapes assumed in this simulation are examples of dual resonance phase-shifting elements. As shown by the solid line 310, the simulated phase shift depends strongly on the hexagon radius $R_1$ in the vicinity of both resonances. The broad range of phase shown in this simulation may be attributed to the use of dual resonance phase-shifting elements.

Simulation of the current flowing in the phase-shifting elements indicates that the first resonance, at $R_1 \approx 0.0196$ inch, may be related to current flowing primarily in the annular hexagon portion of each phase-shifting element. The second resonance, at $R_1 \approx 0.0356$ inch, may be related to current flowing in both the annular hexagon ring and the central solid hexagon shape of each phase-shifting element. Similar nested shapes such as nested circles, nested squares, and other polygonal shapes may also exhibit dual resonance and thus be capable of providing a wide range of phase shift values.

Figure 4:
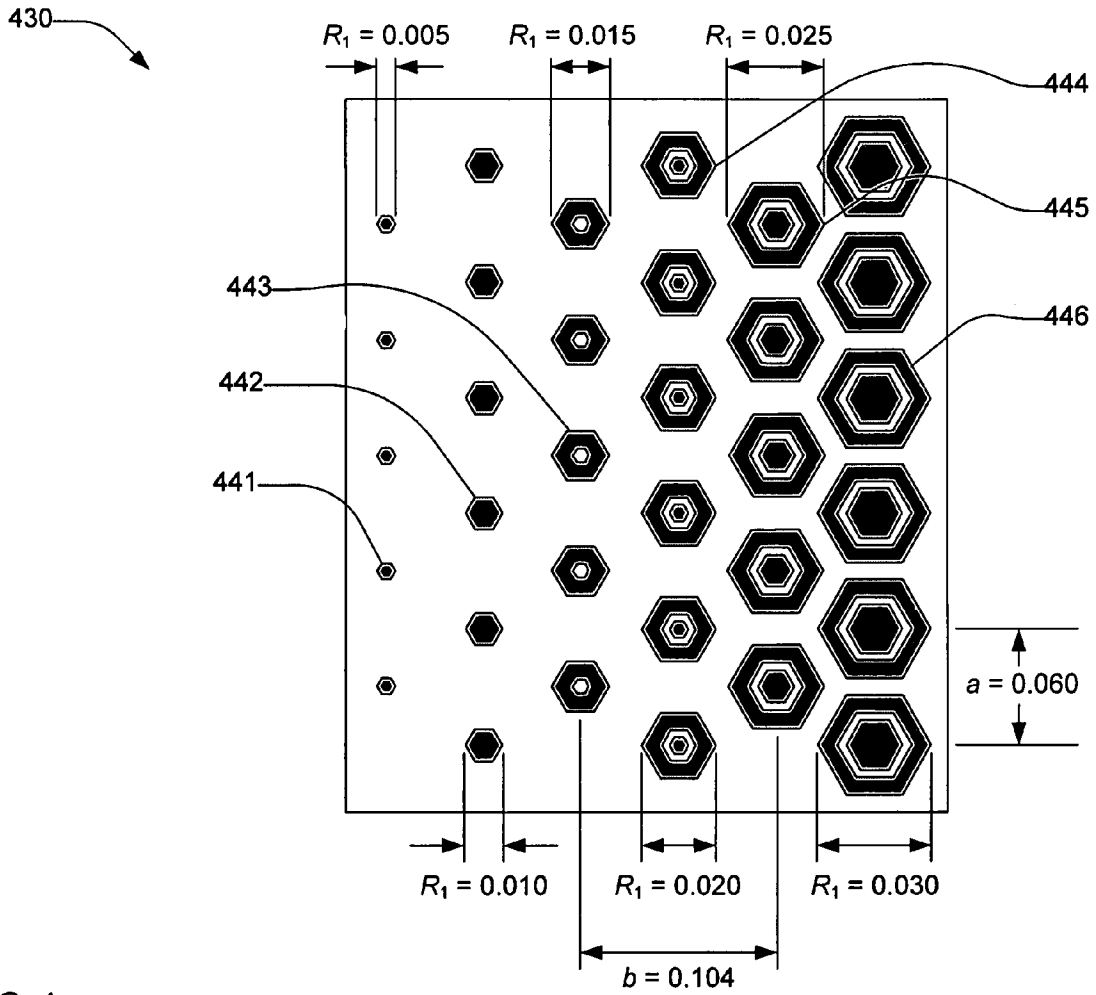
FIG. 4 is a plan view of an array of phase-shifting elements.

The simulation results shown in FIG. 3 were based on a number of assumptions including $R_2=R_1-0.011$ inch and $R_3=R_2-0.004$ inch, where $R_1$, $R_2$, and $R_3$ were defined in FIG. 2. However, with these assumptions, it is not possible to form nested hexagon shapes at values of $R_1$ less than 0.015 inch. Referring now to FIG. 4, an array of phase-shifting elements 430 may include a combination of nested hexagon, annular hexagon, and solid hexagon shapes. For example, phase-shifting elements 441 and 442 are solid hexagons having an outer radius $R_1$ of 0.005 inch and 0.010 inch, respectively. Phase-shifting element 443 is an annular hexagon having an outer radius $R_1$ of 0.015 inch and an inner radius $R_2=R_1-0.011$ inch. Phase-shifting elements 444, 445, and 446 are nested hexagons having an outer radius $R_1$ of 0.020, 0.025, and 0.030 inch, respectively and $R_2=R_1-0.011$ inch and $R_3=R_2-0.004$ inch.

Figure 5:
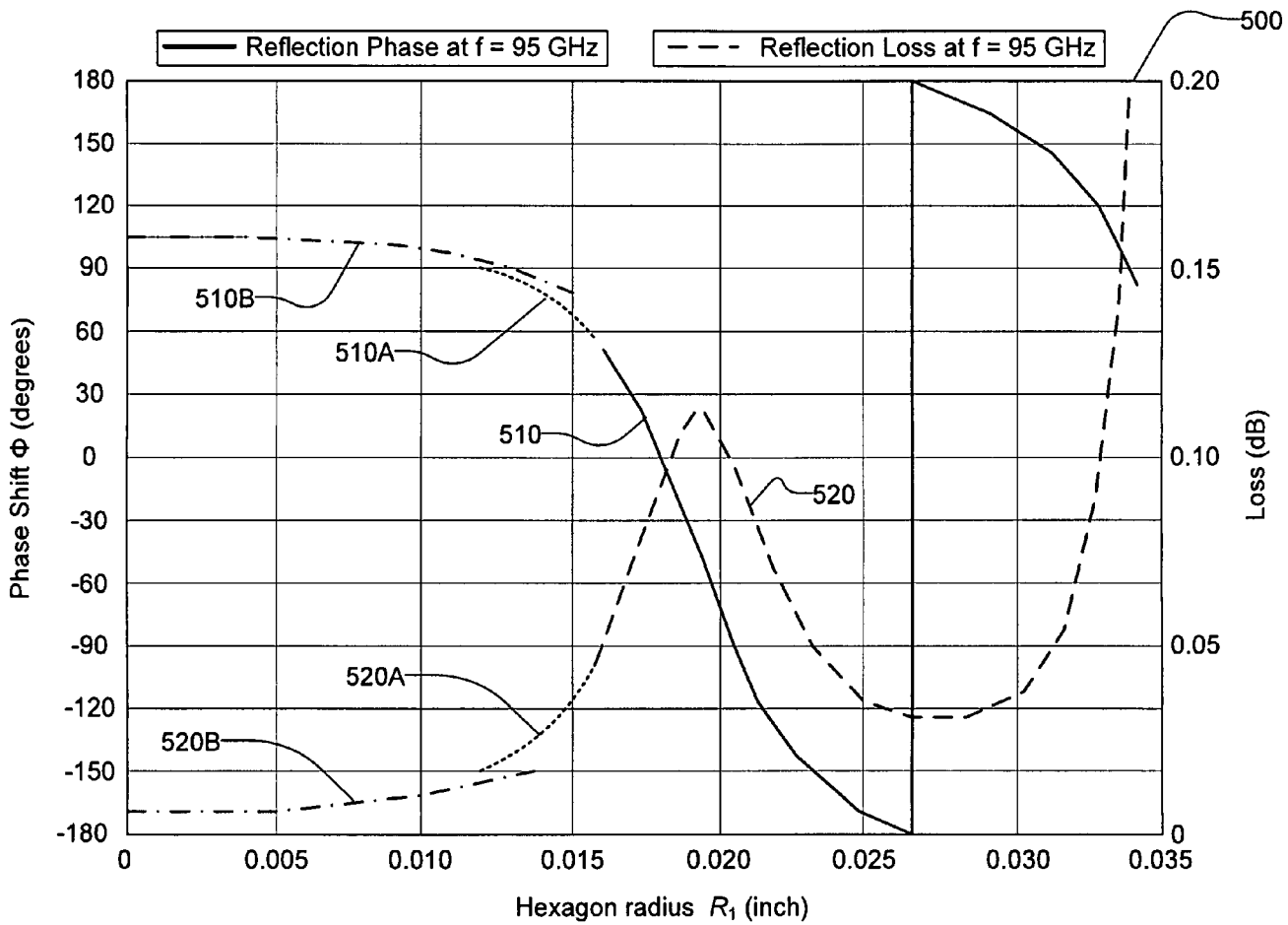
FIG. 5 is a graphical representation of simulation results showing the performance of a variable phase reflect array.

Referring now to FIG. 5, a graph 500 summarizes simulated performance data for a reflect array which incorporates nested hexagon, annular hexagon, and solid hexagon phase-shifting elements similar to those shown in FIG. 4. The graph 500 shows the dependence of reflection phase shift and reflection loss on the dimension $R_1$, which was defined in FIG. 2.

The performance data shown in the graph 500 was derived from simulation using the following assumptions: normal incidence; frequency=95 GHz; substrate thickness t=0.010 inch; substrate material=DUROID®; dimension a=0.060 inch; dimension b=0.104 inch; dimension $R_2=R_1-0.011$ inch; and dimension $R_3=R_2-0.004$ inch.

The solid line 510 defines the phase shift, in degrees, provided by nested hexagonal phase-shifting elements having $R_1$ from 0.016 inch to 0.034 inch. The dotted line 510A defines the phase shift provided by annular hexagonal phase-shifting elements having $R_1$ from 0.012 inch to 0.016 inch. The dot-dash line 510B defines the phase shift provided by solid hexagonal phase-shifting elements having $R_1$ from 0 to 0.012 inch. A variable phase reflect array implemented with a mixture of solid, annular, and nested hexagonal phase-shifting elements may produce any desired phase shift value from −180 degrees to +180 degrees.

The dashed line 520 defines the reflection loss, in dB, provided by nested hexagonal phase-shifting elements having $R_1$ from 0.016 inch to 0.034 inch. The dotted line 520A defines the reflection loss provided by annular hexagon phase-shifting elements having $R_1$ from 0.012 inch to 0.016 inch. The dot-dash line 520B defines the reflection loss provided by solid hexagon phase-shifting elements having $R_1$ from 0 to 0.012 inch. In contrast to the data shown in FIG. 3, the reflection loss of a variable phase reflect array implemented with a mixture of solid, annular, and nested hexagon phase-shifting elements may be less than about 0.12 dB over the entire range of phase shift values.

Figure 6:
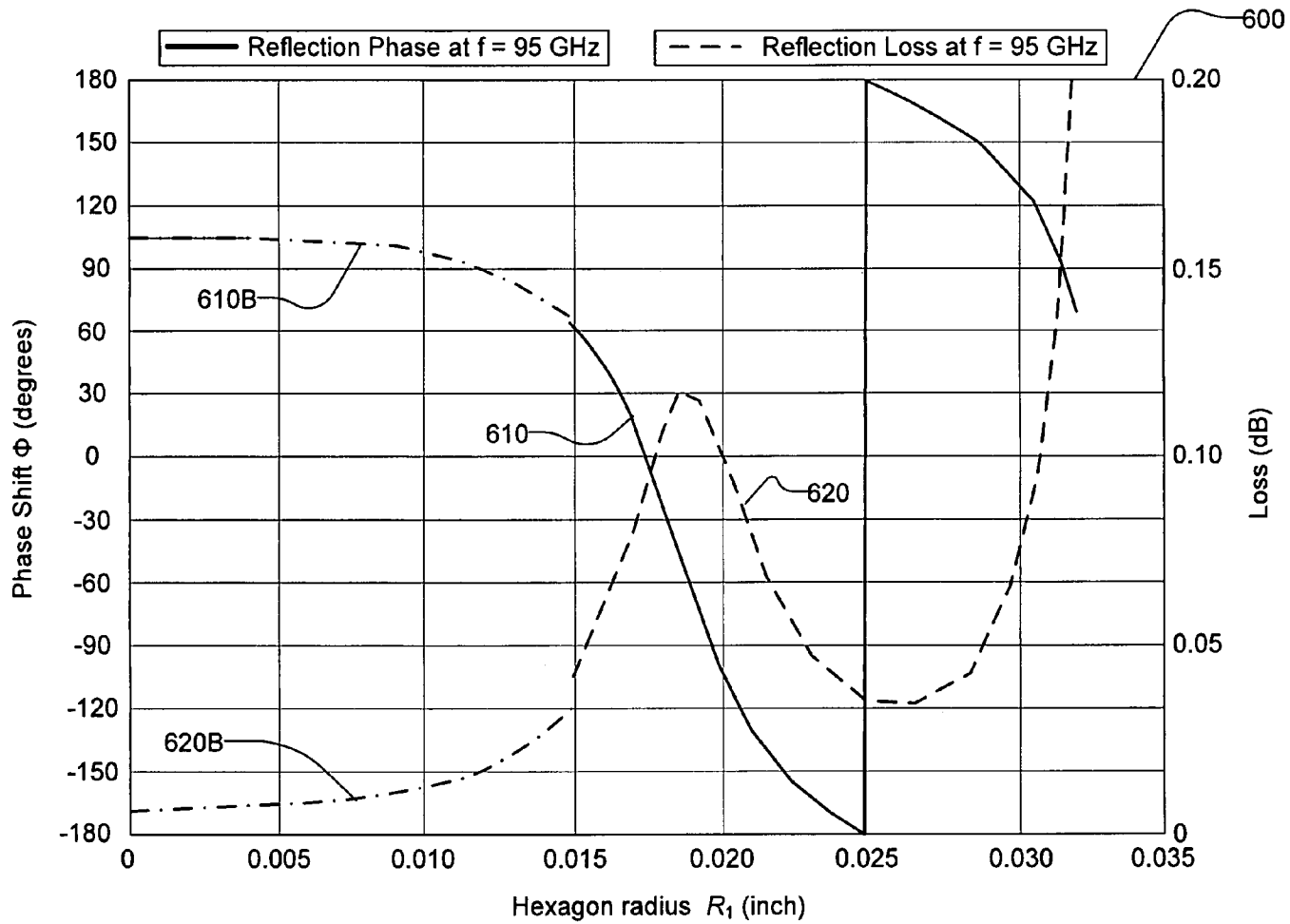
FIG. 6 is a graphical representation of simulation results showing the performance of a variable phase reflect array.

Referring now to FIG. 6, a graph 600 summarizes simulated performance data for another reflect array which incorporates nested hexagon and solid hexagon phase-shifting elements similar to those shown in FIG. 4. The graph 600 shows the dependence of reflection phase shift and reflection loss on the dimension $R_1$, which was defined in FIG. 2.

The performance data shown in the graph 600 was derived from simulation using the following assumptions: normal incidence; frequency=95 GHz; substrate thickness t=0.010 inch; substrate material=DUROID®; dimension a=0.056 inch; dimension b=0.097 inch; dimension $R_2=R_1-0.009$ inch; and dimension $R_3=R_2-0.004$ inch.

The solid line 610 defines the phase shift, in degrees, provided by nested hexagon phase-shifting elements having $R_1$ from 0.015 inch to 0.032 inch. The dot-dash line 610B defines the phase shift provided by solid hexagon phase-shifting elements having $R_1$ from 0 to 0.015 inch. The variable phase reflect array implemented with a mixture of solid and nested hexagon phase-shifting elements may produce any desired phase shift value from −180 degrees to +180 degrees.

The dashed line 620 defines the reflection loss, in dB, provided by nested hexagon phase-shifting elements having $R_1$ from 0.015 inch to 0.032 inch. The reflection loss of the nested hexagon phase-shifting elements exhibits dual resonance peaks. The dot-dash line 620B defines the reflection loss provided by solid hexagon phase-shifting elements having $R_1$ from 0 to 0.015 inch. Similar to the data shown in FIG. 5, the reflection loss of the variable phase reflect array implemented with a mixture of solid and nested hexagon phase-shifting elements may be less than about 0.125 dB over the entire range of phase shift values.

FIG. 3, FIG. 5, and FIG. 6 show simulation results for three exemplary variable phase reflect arrays. The three simulated reflect arrays are point designs within a continuum of possible designs that may provide variable phase shift over a full 360° range and low reflection loss. Similar results may be obtained for other point designs within the range of dimensions and assumptions used in these three examples.

FIG. 3, FIG. 5, and FIG. 6 show simulation results for three exemplary variable-phase reflect arrays assuming normally incident microwave energy at a specific frequency of 95 GHz. Similar results may be obtained for non-normal angles of incidence or reflection by suitable choice of physical parameters. These results may extend to other frequencies about 95 GHz, where "about 95 GHz" includes any frequency within the 94 GHz atmospheric radio window. Similar results may be obtained for other frequencies by scaling the assumed physical parameters.

Description of Processes

Referring again briefly to FIG. 1, a process for providing a beam of microwave energy may include generating microwave energy using a source such as microwave energy source 110, and forming the generated microwave energy into a beam of microwave energy, such as microwave energy beam 115, using a beam director such as beam director 120 which may include a dual resonance variable phase reflect array as described herein.

Figure 7:
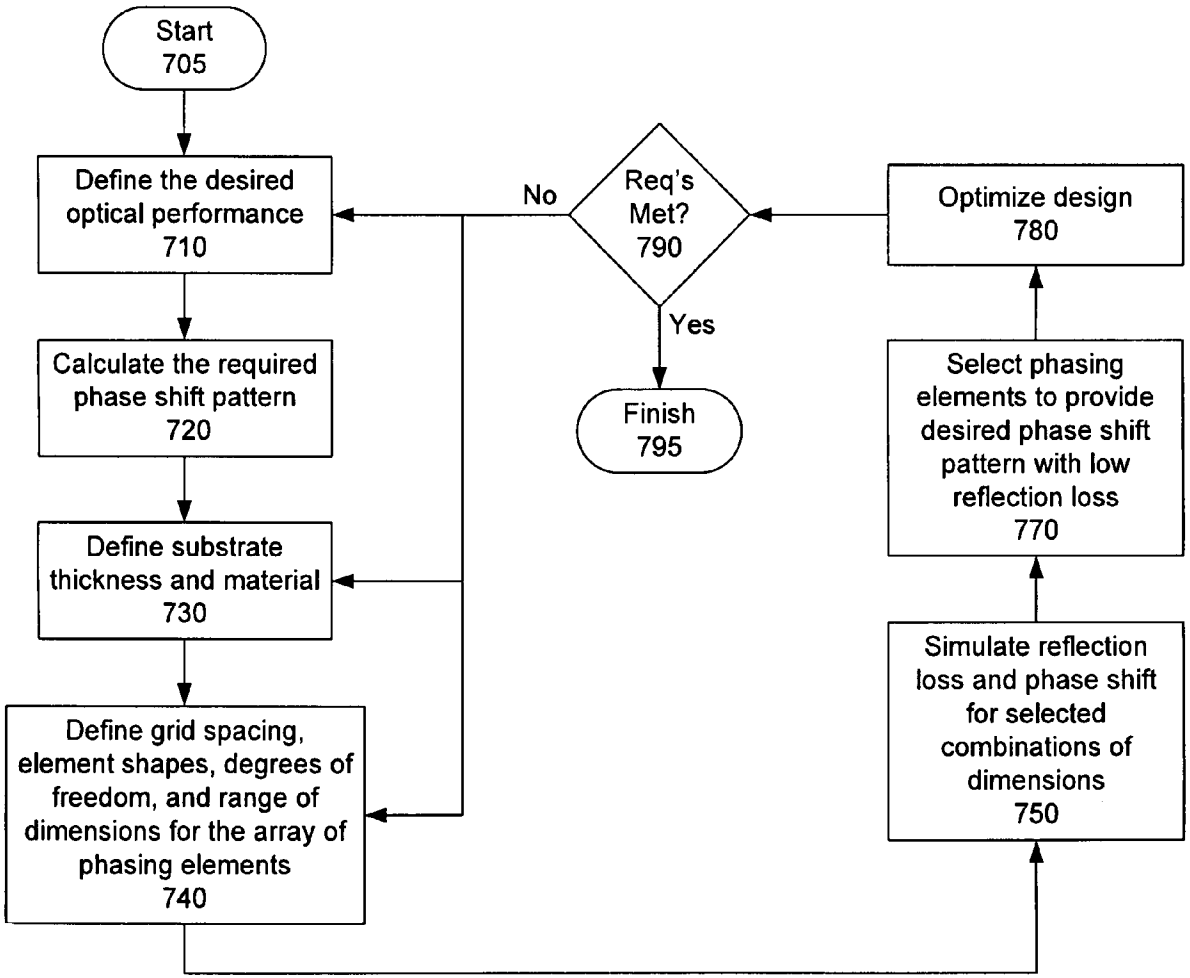
FIG. 7 is a flow chart of a process to design a variable phase reflect array.
Figure 8:
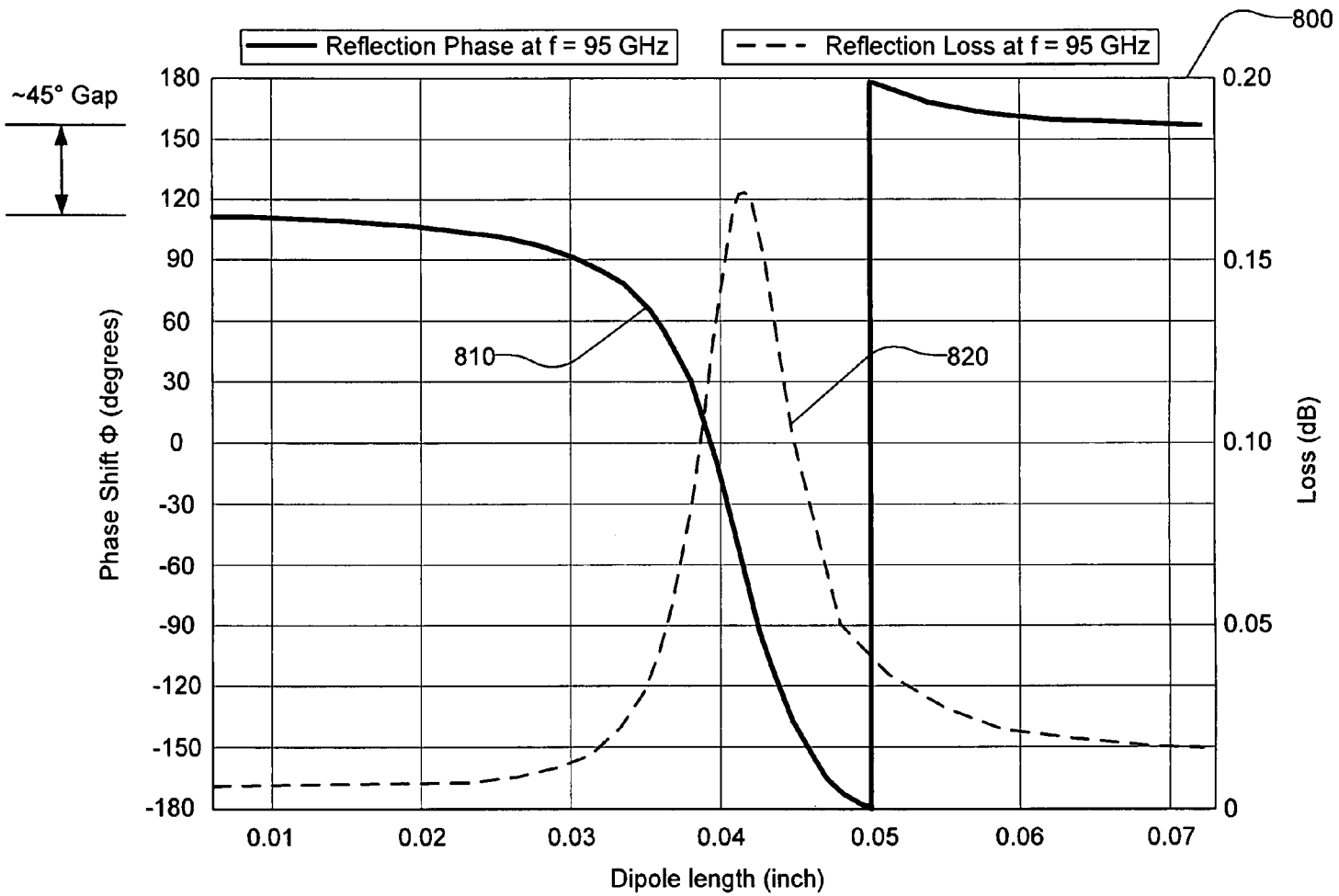
FIG. 8 Prior Art
FIG. 8 is a graphical representation of simulation results showing the performance of a prior art reflect array.

Referring now to FIG. 7, a process 700 for designing a reflect array has both a start 705 and an end 795, but the process is cyclical in nature and may be repeated iteratively until a successful design is achieved. At 710 the optical performance desired for the reflect array may be defined. For example, the defined performance may include converting an incident beam having a first wavefront into a reflected beam having a second wavefront, where the second wavefront is not a specular reflection of the first wavefront. The desired performance may also include a definition of an operating wavelength or range of wavelengths, and a maximum reflection loss. The reflect array may commonly be a component in a larger system and the desired performance of the reflect array may be defined in conjunction with the other components of the system.

At 720, the required phase shift pattern, or phase shift as a function of position on the reflect array, may be calculated from the wavelength and the first and second wavefronts defined at 710.

At 730, the substrate material and thickness may be defined. The substrate material and thickness may be defined based upon manufacturing considerations or material availability, or some other basis.

At 740, the grid spacing, phase-shifting element shape, degrees of freedom (how many dimensions that are allowed to vary during the design process), and range of dimensions for the array of phase-shifting elements may be defined. These parameters may be defined by assumption, experience, adaptation of prior designs, other methods, and combinations thereof.

At 750, the reflection phase shift and reflection loss may be calculated by simulating the performance of the reflect array using a suitable simulation tool. For example, assume that the degrees of freedom defined at 740 are a selection of three different phase-shifting element shapes (i.e. solid, annular, and nested) and a single variable dimension. At 750, a plurality of values spanning the full range of the variable dimension may be selected, and the reflection phase shift and reflection loss may be calculated may be calculated for each phase-shifting element shape at all of the values.

At 770, the calculated results from 750 may be evaluated and phase-shifting elements may be selected that provide the desired phase shifts at low reflection loss. For example, the data from 750 may be graphed as shown in FIGS. 3, 5, and 6, and the appropriate phase-shifting elements may be determined by observation. The appropriate phase-shifting elements may also be selected by numerical analysis of the data from 750.

At 780, the performance of the entire reflect array may be simulated and the design may be optimized by adjustment and iteration.

At 790, the simulated performance of the reflect array from 780 may be compared to the optical performance requirements defined at 710. If the design from 780 meets the performance requirements from 710, the process 700 may finish at 795. If the design from 780 does not meet the performance requirements from 710, the process may repeat from steps 710 (changing the optical performance requirements), from 730 (changing the substrate selection), or from 740 (changing the grid spacing, element shapes, degrees of freedom, or range of dimensions) until the optical performance requirements have been satisfied.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A reflect array, comprising a dielectric substrate having a first surface and a second surface a continuous conductive layer supported by the second surface a plurality of phase-shifting elements formed on the first surface wherein at least some of the phase-shifting elements are dual resonance phase-shifting elements wherein a phase shift of a reflected microwave beam at a predetermined operating frequency can be set to any value over a continuous 360-degree range by selecting one or more dimensions of the phase-shifting elements.

2. The reflect array of claim 1, wherein the phase shift of a microwave beam reflected from the reflect array is varied over a continuous 360-degree range across an extent of the reflect arrays by varying at least one variable dimension of the phase-shifting elements.

3. The reflect array of claim 2, wherein the dual resonance phase-shifting elements have a shape that results in resonance at the operating frequency at two different values of a variable dimension.

4. The reflect array of claim 2, wherein the dielectric substrate has a first curvature the at least one variable dimension is varied across the extent of the reflect array to cause the reflect array to emulate a reflector having a second curvature different from the first curvature.

5. The reflect array of claim 4, wherein the dielectric substrate is planar the reflect array emulates a non-planar reflector.

6. The reflect array of claim 5, wherein the reflect array emulates a curved reflector selected from the group consisting of a parabolic reflector, a spherical reflector, a cylindrical reflector, a torroidal reflector, a conic reflector, and a generalized aspheric reflector.

7. The reflect array of claim 4, wherein the dielectric substrate has a curvature selected from the group consisting of spherical and cylindrical the reflect array emulates an aspheric reflector selected from the group consisting of a parabolic reflector, a torroidal reflector, a conic reflector, and a generalized aspheric reflector.

8. The reflect array of claim 1, wherein the dual resonance phase-shifting elements are nested elements including a solid inner conductor surrounded by a concentric annular conductor.

9. The reflect array of claim 8, wherein the dual resonance phase-shifting elements are nested hexagons.

10. The reflect array of claim 9, wherein the plurality of phase-shifting elements includes nested elements and at least one of annular elements and solid elements.

11. The reflect array of claim 10, wherein the plurality of phase-shifting elements includes nested hexagons, annular hexagons, and solid hexagons.

12. The reflect array of claim 11, wherein an operating frequency of the reflect array is about 95 GHz the plurality of phase-shifting elements are disposed in a triangular array a distance between adjacent rows of the triangular array is a dimension a, where $0.056'' \leqq a \leqq 0.065''$ a distance between adjacent phase-shifting elements in each row of the triangular array is a dimension b, where $b=2a\cos(30°)$ each of the plurality of phase-shifting elements is characterized by a variable $R_1$ which is the radius of a circle that may be circumscribed about the phase shifting element, where $R_1 \leqq 0.035''$.

13. A system for generating a beam of microwave energy, comprising a microwave energy source a beam director to direct energy received from the microwave energy source into a beam of microwave energy having a predetermined operating frequency, the beam director including a primary reflector comprising a dielectric substrate having a first surface and a second surface a continuous conductive layer supported by the second surface a plurality of phase-shifting elements formed on the first surface wherein at least some of the phase-shifting elements are dual resonance phase-shifting elements wherein one or more dimensions of the phase-shifting elements are varied across an extent of the primary reflector to vary a local phase shift of a reflected microwave beam over a continuous 360-degree range.

14. A method of generating a beam of microwave energy, comprising generating microwave energy having a predetermined operating frequency forming the microwave energy into a beam with a beam director, the beam director including a primary reflector comprising a dielectric substrate having a first surface and a second surface a continuous conductive layer supported by the second surface a plurality of phase-shifting elements formed on the first surface wherein at least some of the phase-shifting elements are dual resonance phase-shifting elements wherein one or more dimensions of the phase-shifting elements are varied across an extent of the primary reflector to vary a local phase shift of a reflected microwave beam over a continuous 360-degree range.

15. The reflect array of claim 1, wherein a reflection loss at the predetermined operating frequency is less or equal to 0.125 dB for any reflection phase within the continuous 360-degree range.

* * * * *